US006434892B1

(12) United States Patent
Heierli

(10) Patent No.: US 6,434,892 B1
(45) Date of Patent: Aug. 20, 2002

(54) OVERFILLED, PRECAST SKEWED ARCH BRIDGE

(76) Inventor: Werner Heierli, Biberlinstrasse 28, CH 8032 Zurich (CH)

( * ) Notice: Subject to any disclaimer, the term of this patent is extended or adjusted under 35 U.S.C. 154(b) by 0 days.

(21) Appl. No.: 09/520,636

(22) Filed: Mar. 7, 2000

(51) Int. Cl.[7] ..... E04B 1/32; E01F 5/00
(52) U.S. Cl. ..... 52/87; 52/86; 405/125
(58) Field of Search ..... 405/125, 124; 14/24, 69.5; 52/86, 263

(56) References Cited

U.S. PATENT DOCUMENTS 4,558,969 A * 12/1985 FitzSimons ..... 405/124
4,587,684 A * 5/1986 Miller ..... 14/24
4,993,872 A * 2/1991 Lockwood ..... 405/125

* cited by examiner

*Primary Examiner*—Carl D. Friedman
*Assistant Examiner*—Basil Katcheves
(74) *Attorney, Agent, or Firm*—Terry M. Gernstein

(57) ABSTRACT

An overfilled, pre-cast reinforced concrete arch bridge for supporting one pathway above a second pathway in which the projections of the pathways intersect at an oblique angle. The bridge includes a plurality of identically shaped arch elements that are offset from each other to form a staggered orientation whereby a skewed bridge is formed without specially shaped arch elements. Cover elements can be used to prevent migration of soil or water into the bridge and various forms of arch elements can be used in the bridge.

33 Claims, 9 Drawing Sheets

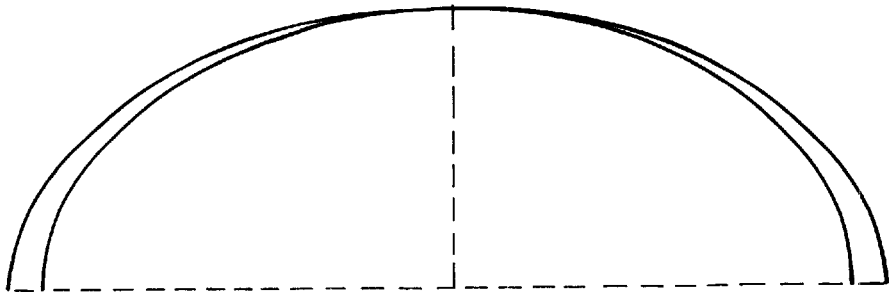
FIG. 16.
FIG. 17.
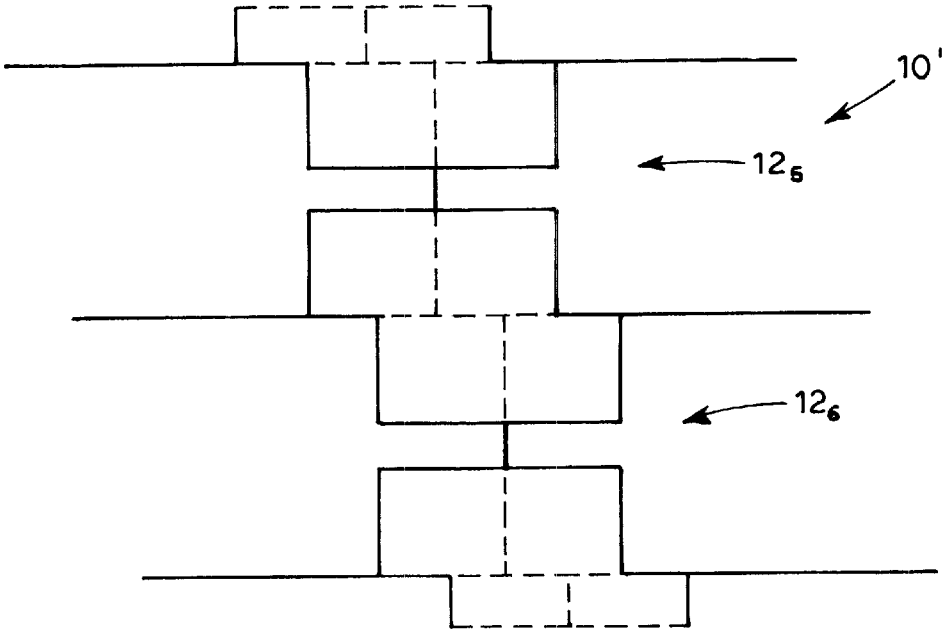

OVERFILLED, PRECAST SKEWED ARCH BRIDGE

TECHNICAL FIELD OF THE INVENTION

The present invention relates to the general art of bridges, and to the particular field of over-filled, pre-cast, reinforced concrete arch bridges.

BACKGROUND OF THE INVENTION

Frequently, overfilled bridges formed of pre-cast reinforced concrete arch elements are used to support one pathway over a second pathway, which can be a waterway, a traffic route or the like. The terms "overfilled arch" or "overfilled bridge" will be discussed in greater detail below, but in general, an overfilled bridge is a bridge formed of arch elements that rest on the ground or on a foundation and has soil or the like resting thereon to support and stabilize the bridge. The arch elements are usually arcuate in shape to be generally cylindrical in circumferential shape, and in particular a prolate shape; however, other shapes can be used. An example of an overfilled bridge of the present disclosure is disclosed in U.S. Pat. Nos. 3,482,406 and 4,458,457, the disclosures of which are incorporated herein by reference.

Often, the horizontal projections of the two pathways do not intersect at a right angle. As used herein, a "skewed angle" is an oblique, or non-right, angle, that is, an angle unequal to 90° (≠90°). The skewed angle between the two pathways presents several problems for the bridge designer and the bridge builder, especially if the bridge is formed of pre-cast elements as opposed to cast-in-place concrete which can accommodate the skewed angular relationship of the two pathways.

As shorthand, bridges associated with pathways that are oriented at an oblique angle with respect to each other will sometimes be referred to as "skewed bridges." Elements included in such skewed bridges will be referred to as "skewed elements." Likewise, a bridge associated with pathways that are oriented at a right angle with respect to each other will sometimes be referred to as a "non-skewed" bridge and will include "non-skewed" elements.

Heretofore, bridges associated with skewed pathways have included trapezoidal end arch elements to lengthen the bridge at the ends thereof. However, this solution involves customized arch elements. Customized arch elements create several problems and can be costly from the standpoint of equipment and design. Furthermore, aesthetic considerations may be difficult with such designs.

Still further, such specially shaped elements may be difficult to store resulting in a lack of inventory of such elements by a manufacturer. Accordingly, skewed bridges using customized arch elements may take much longer to erect than non-skewed bridges because the elements must be specially fabricated and stock elements which may be on hand cannot be used. Bridges formed of customized elements may also be more expensive than bridges formed of stock elements.

Due to unusual shapes of customized elements, the design calculations, planning, and considerations may be much more difficult and complex for a skewed bridge than for a non-skewed bridge. Due to the unusual elements required certification from appropriate agencies may be difficult and tortuous to obtain for such customized elements. This further adds to the cost and time associated with skewed bridges using the teaching of the prior art as compared to non-skewed bridges.

A further problem associated with the specially designed arch elements is concerned with the elements associated with the arch elements. For example, a spandrel wall designed to be associated with non-skewed arch elements may not work with an arch element that has been specially designed for a skewed bridge. The same problems are associated with foundations, wing walls, joints and the like. The foundation in particular may have to be specially designed, certified, procured and placed for a skewed bridge using such customized arch elements. In fact, the overfill, itself, may have to be designed specially for a skewed bridge using prior art designs. All of this is costly, both in expense and time, difficult and may require special procedures both in design and in the erection process as well as in the bidding and certification process.

Specially designed arch elements used in skewed bridges may also present aesthetic problems since an element or a portion of an element may extend out of the overfill at one or both ends of the bridge. This extension must be accounted for and the overfill modified accordingly. Such modification may be time consuming and costly.

Yet further problems with specially designed bridge elements are associated with the transportation thereof. Non-standard procedures, routes and equipment may be required to ship specially designed bridge elements from a manufacturer to a bridge site. This can be expensive and time consuming.

Therefore, there is a need for a means and method for erecting an overfilled, pre-cast reinforced concrete bridge associated with two pathways that are oriented at an oblique angle with respect to each other and that is easily designed, certified, fabricated, shipped and erected.

OBJECTS OF THE INVENTION

It is a main object of the present invention to provide an overfilled, pre-cast, reinforced concrete arch bridge that supports one pathway over another pathway that is oriented at a skewed angle with respect to the first pathway.

It is another object of the present invention to provide an overfilled, pre-cast, reinforced concrete skewed arch bridge that is formed of a plurality of identical arch elements.

It is another object of the present invention to provide an overfilled, pre-cast, reinforced concrete skewed arch bridge that is formed of a plurality of arch elements each of which is non-skewed.

It is another object of the present invention to provide an overfilled, pre-cast, reinforced concrete skewed arch bridge that is formed of a plurality of arch elements that are pre-cast and are similar to arch elements used in non-skewed bridges.

It is another object of the present invention to provide an overfilled, pre-cast, reinforced concrete skewed arch bridge that is formed of a plurality of arch elements that are not specially designed for a skewed bridge.

It is another object of the present invention to provide an overfilled, pre-cast, reinforced concrete skewed arch bridge that is formed of a plurality of arch elements that are supported on a unitary foundation.

It is another object of the present invention to provide an overfilled, pre-cast, reinforced concrete skewed arch bridge that is formed of a plurality of non-skewed arch elements that are independent of each other.

It is another object of the present invention to provide an overfilled, pre-cast, reinforced concrete skewed arch bridge that is formed of a plurality of non-skewed arch elements that can be used for either a skewed bridge or a non-skewed bridge.

It is another object of the present invention to provide an overfilled, pre-cast, reinforced concrete skewed arch bridge that is formed of a plurality of non-skewed arch elements that uses essentially the same considerations, calculations and procedures as a non-skewed bridge.

It is another object of the present invention to provide an overfilled, pre-cast, reinforced concrete skewed arch bridge that is formed of a plurality of non-skewed arch elements that can include accessories that are the same as a non-skewed bridge.

It is another object of the present invention to provide an overfilled, pre-cast, reinforced concrete skewed arch bridge that is formed of a plurality of non-skewed arch elements that can be formed from easily modified, stock, standard non-skewed arch elements.

SUMMARY OF THE INVENTION

These, and other, objects are achieved by a providing a skewed overfilled arch bridge formed of a plurality of pre-cast reinforced concrete non-skewed arch elements. The arch elements rest on a foundation structure that is slightly modified from that design used in connection with a non-skewed bridge, but is still quite simple and all other elements, including spandrel walls, wing walls and the like, can be identical to the corresponding elements used in a non-skewed bridge. Even if the foundation is cast in place, the overall construction of the skewed bridge of the present invention is much simpler than the skewed bridges of the prior art because the arch elements of the skewed bridge of the present invention can be pre-cast in the same manner as the arch elements of non-skewed bridges.

Accordingly, a manufacturer can have a large stock of arch elements whereby arch elements are readily available, shipping is carried out in the known manner, and certification procedures are greatly simplified because the elements have already been certified. Shipping considerations as well as on-site erection procedures can closely follow already known considerations and procedures associated with non-skewed bridges. Thus, the overall process of design, bidding, certification, construction and qualification are essentially identical to the non-skewed bridge processes. Accordingly, costs, times and procedures associated with a skewed bridge are quite predictable and greatly reduced from the situation of skewed bridges erected using customized and/or special elements.

BRIEF DESCRIPTION OF THE DRAWING FIGURES

FIG. 16 shows an minimum clear area which is spanned by the skewed overfilled, reinforced concrete arch bridge of the present invention.

FIG. 17 is a plan view of a twin leaf form of the skewed overfilled precast reinforced concrete arch bridge of the present invention.

DETAILED DESCRIPTION OF THE PREFERRED EMBODIMENT OF THE INVENTION

Other objects, features and advantages of the invention will become apparent from a consideration of the following detailed description and the accompanying drawings.

Figure 1:
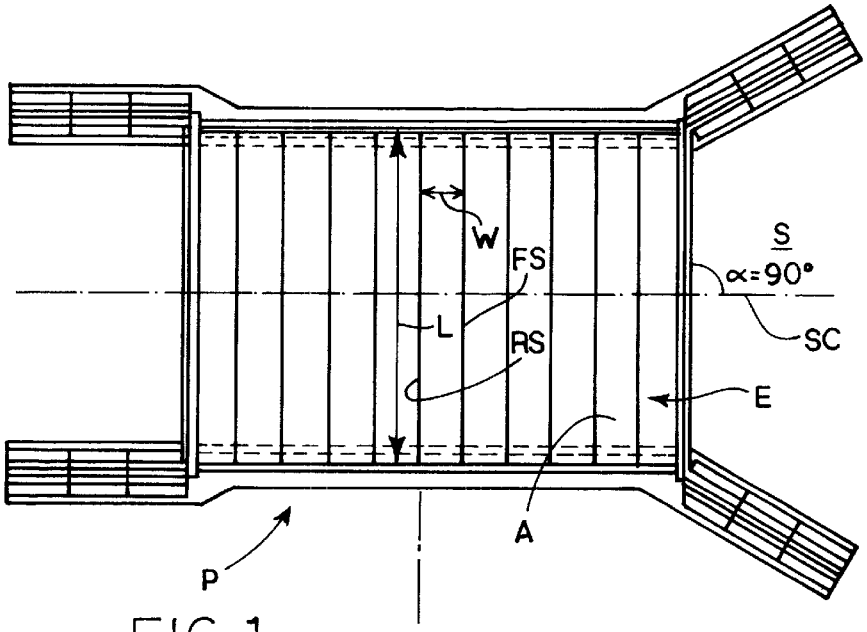
FIG. 1. (PRIOR ART)
FIG. 1 is a top plan view of a non-skewed bridge.

By way of background, an overfilled, pre-cast reinforced concrete arch is disclosed and discussed in relation to FIG. 1 of U.S. Pat. No. 4,458,457, the disclosure of which is incorporated herein by reference. As disclosed in this incorporated patent, arch elements are supported on foundations and can be connected together by joints. Overfill rests on the arch elements and an overpass pathway or traffic route rests on the overfill, and an underpass pathway or traffic route is located beneath the overfilled, pre-cast reinforced arch bridge. As taught in the other incorporated patent, U.S. Pat. No 3,482,406, as well as U.S. Pat. No. 4,537,529, the disclosure of which is also incorporated herein by reference, the overfill supports the bridge elements as well as the overpass pathway.

Referring now to FIG. 1, a prior art bridge P is shown which supports a first pathway F over a second pathway S. First pathway F includes a longitudinal centerline FC and second pathway S includes a longitudinal centerline SC. Centerline SC is oriented at a right angle with respect to centerline FC whereby the first and second pathways are orthogonal with respect to each other. As shown in FIG. 1, bridge P includes a plurality of arch elements such as arch element A. Each arch element is arcuate in peripheral shape, preferably a prolate arch element having an elongated shape such as shown in U.S. Pat. 4,558,969, the disclosure of which is incorporated herein by reference. Prolate arch elements are also shown in FIGS. 6–9 herein. Each arch element includes a length dimension L, a front surface FS and a rear surface RS. Front surface FS is contained in a front plane and rear surface RS is contained in a rear plane which is spaced from the front surface along a widthwise dimension of the arch element. Thus, each arch element has a width dimension W measured between the front and rear surfaces thereof. For purposes of this disclosure, the pathways intersecting at the bridge location, i.e., first and second pathways F and S, define an angle a with respect to each other. Angle $\alpha$ will be referred to as the intersection angle between the intersecting pathways. The pathways shown in FIG. 1 intersect to define a intersection angle of 90°. As can be seen in FIG. 1, second pathway longitudinal centerline SC is oriented at a right angle with respect to the front surface of an endmost arch element E whereby the angle formed between second pathway centerline SC and front surface FS of endmost arch element E is equal to intersection angle a between the two pathways. However, as will be understood from the following disclosure, the angle formed between the centerline of the first pathway S and the front surface of the endmost arch element will always equal the intersection angle $\alpha$ due to geometric considerations. As will be discussed below, the invention embodying the present invention is associated with a intersection angle $\alpha$ that is oblique, that is, unequal to 90°. As shown in FIG. 1, the arch elements are all oriented to have the length dimensions thereof oriented parallel to longitudinal centerline FC of first pathway F and the width dimensions thereof parallel to longitudinal centerline SC of the second pathway. In the case shown in FIG. 1, centerlines FC and SC are oriented at 90° with respect to each other and intersection angle $\alpha$ =90°.

Figure 2:
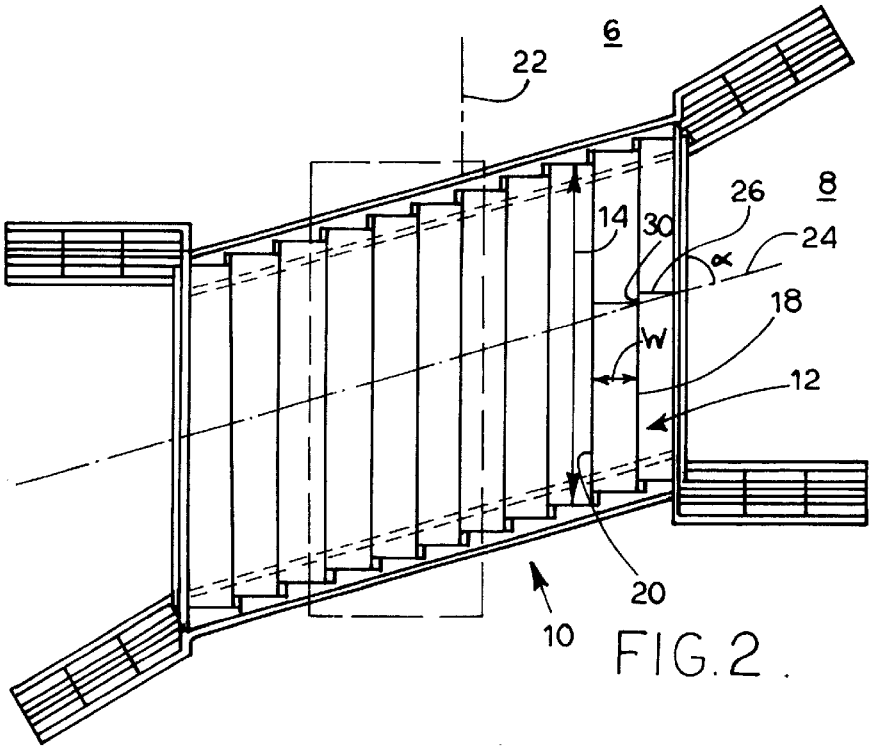
FIG. 2 is a top plan view of a skewed bridge embodying the present invention.

As discussed above, in some instances first and second pathways intersect at a intersection angle $\alpha \neq 90°$. This situation is indicated in FIG. 2 which shows an oblique intersection angle between first and second pathways 6 and 8. An overfilled, pre-cast, reinforced concrete bridge 10 is used to elevate first pathway 6 over second pathway 8 when the two pathways are oriented at an oblique intersection angle. As shown in FIG. 2, bridge 10 includes a plurality of arch elements 12 each of which includes a length dimension 14 measured along the direction of first pathway 6 and a width dimension 16, with width dimension W being measured between front surface 18 and rear surface 20 of an arch element. Front surface 18 is contained in a plane and rear surface 20 is contained in a plane, with the planes containing the front and rear surface of each arch element being parallel to each other and extending along the direction of longitudinal centerline 22 of first pathway 6. As can be understood from general geometric principles, since the front and rear surfaces of the arch elements 12 are parallel to each other and to longitudinal centerline 22 of pathway 6 and longitudinal centerline 24 of pathway 8 forms a intersection angle a with respect to longitudinal centerline 22, intersection angle a is equal to the angle formed between the front surface 18 of each arch element and longitudinal centerline 24 of second pathway 8.

As discussed above, when the intersection angle between the two pathways is oblique, prior art overfilled precast bridges used specially formed arch elements and/or specially formed overfill to form the bridge and accommodate the oblique intersection angle. As also discussed above, such special considerations created drawbacks. The present invention uses arch elements that are identical to the arch elements used in non-skewed bridges (that is, a bridge in which the two intersecting pathways form an angle $\alpha$=90°, i.e., a right angle), such as shown in FIG. 1, in a manner that permits a skewed bridge (that is a bridge which permits the intersection of two pathways to define an angle $\alpha \neq 90°$, i.e., an oblique angle) to be formed of the non-skewed bridge arch elements. This provides the advantages discussed above.

Thus, still referring to FIG. 2, it is seen that overfilled, pre-cast reinforced concrete bridge 10 embodying the present invention for forming the intersection between two obliquely oriented pathways 6 and 8 and which includes a plurality of arch elements 12 having the length dimensions thereof extending along pathway 6 and the width dimension of each arch element extending parallel to the width dimension of adjacent arch elements. The width dimension of each arch element is oriented at an angle $\alpha$ with respect to the longitudinal centerline 24 of second pathway 8. Each arch element includes a widthwise centerline, such as widthwise centerline 26, extending from front surface 18 to rear surface 20 of the corresponding arch element. The widthwise centerline of one arch element is offset or spaced from the widthwise centerlines of adjacent arch elements by a spacing 30, whereby viewed in elevational view from direction 32, each arch element is staggered from adjacent arch elements along the length dimension of the arch elements. The stagger can be seen in FIGS. 6–9. As can be understood from FIGS. 2 and 6–9, spacing 30 is located in a horizontal plane.

By adjusting the amount of stagger, that is, the size of spacing 30, identically shaped widthwise and lengthwise parallel arch elements 12 can be oriented to extend along the direction of pathway 24, that is along longitudinal centerline 24, and yet accommodate pathway 6 which is oriented at an oblique intersection angle with respect to pathway 8. By comparing FIGS. 1 and 2, it can be seen that the orientation directions of the arch elements used in the non-skewed bridge P are identical to the orientation directions of the arch elements used in the skewed bridge 10; however, the arch elements 12 of skewed bridge 10 are staggered with respect to each other whereas arch elements E of non-skewed bridge P are not staggered with respect to each other. The staggered orientation of arch elements 12 permits these arch elements to accommodate the skewed orientation of pathways 6 and 8 while still using the same arch elements E used in the non-skewed bridge P to form a skewed bridge 10. No special arch elements need be fabricated for bridge 10 and overfill need not be adjusted to accommodate arch elements in bridge 10. This provides the advantages discussed above and overcomes the disadvantages discussed above in regard to a skewed bridge formed of specially formed arch elements.

Figure 3:
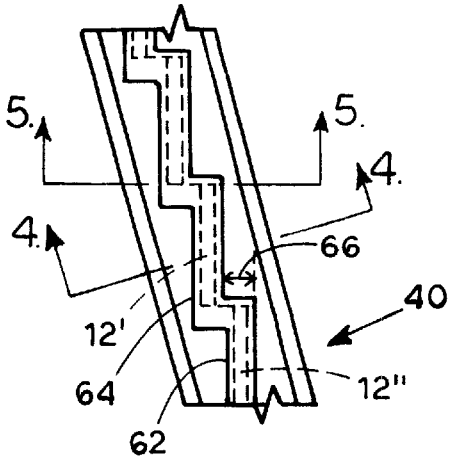
FIG. 3 is a top plan view of a foundation unit associated with the skewed bridge embodying the present invention.
Figure 4:
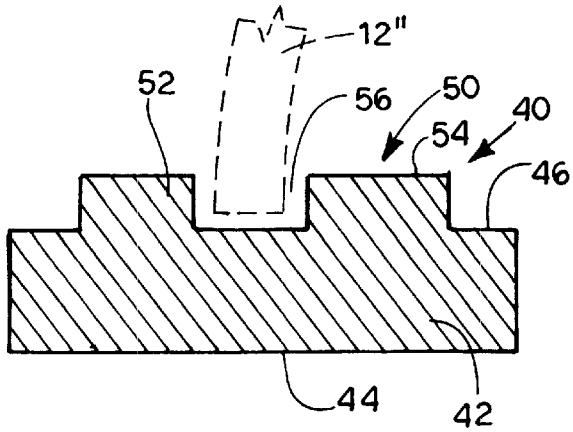
FIG. 4 is an elevational view taken along line 4—4 of FIG. 3.
Figure 5:
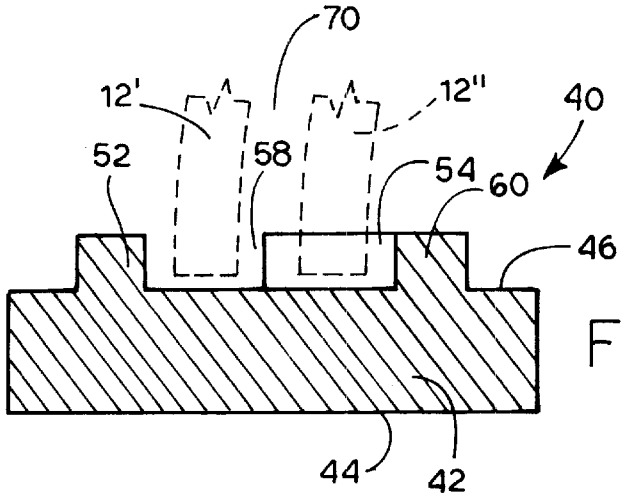
FIG. 5 is an elevational view taken along line 5—5 of FIG. 4.

If a foundation footing is used in conjunction with bridge 10, such a foundation footing must be modified to accommodate the staggered orientation of adjacent arch elements. A foundation footing 40 that will accommodate the staggered orientation of the arch elements without creating a foundation footing that is unduly difficult to manufacture, store and ship is shown in FIGS. 3–5 and reference is now made to those figures. Foundation footing 40 can be cast in place if suitable.

As shown in FIGS. 3–5, foundation footing 40 includes a base 42 having a bottom surface 44 which is adapted to rest on the ground and a surface 46 spaced above bottom surface 42 when foundation footing 40 is in place. A foundation key 50 is defined by a first sidewall 52 and a second sidewall 54 which are spaced apart by a gap 56 at location A—A shown in FIGS. 3 and 4, and It by a gap 58 between sidewalls 52 and 60 at location B—B shown in FIGS. 3 and 5, with gap 58 being larger than gap 56. As can be seen in FIG. 3, gaps 56 and 58 intersect each other to define an L-shaped keyway. The sizes of gaps 56 and 58 are adjusted in accordance with the stagger between adjacent arch elements in bridge 10. That is, the size differential between gaps 56 and 58 corresponds to the size of spacing 30 between the widthwise dimensions of two adjacent arch elements whereby one arch element is accommodated in a first foundation key section 62 and an adjacent arch element is accommodated in second key section 64 which is offset from the first foundation key section 62 by an amount 66 which corresponds to spacing 30 between the widthwise dimensions of the adjacent arch elements. Staggered arch elements 12' and 12" are indicated in FIGS. 3 and 5. As indicated in FIG. 3, the foundation key sections are zig-zag with respect to each other to maintain the associated arch elements parallel to each other yet accommodate the stagger between adjacent arch elements and to permit the foundation unit to extend along the direction of one of the skewed pathways. As shown in FIG. 2, the footing unit can extend along pathway 8.

Figure 6:
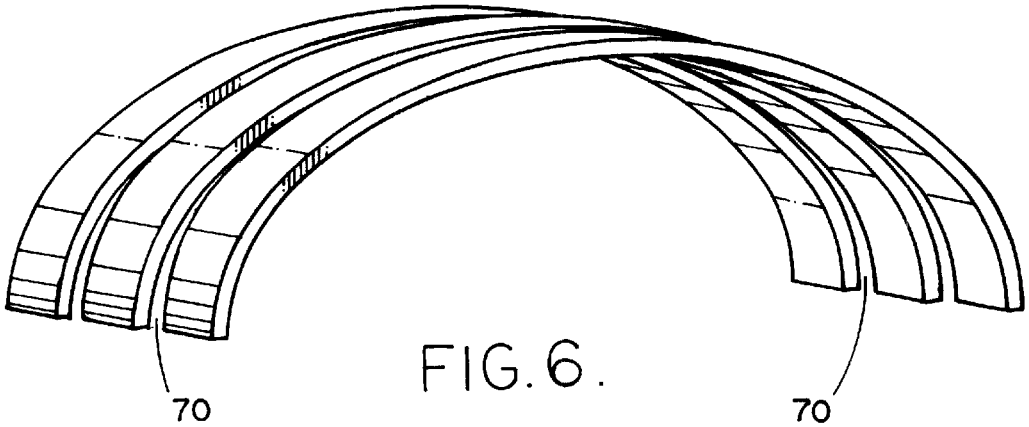
FIG. 6 is a perspective view of a skewed bridge of the present invention where arch elements are staggered in a way to establish a skew angle of 75°.

As can be understood from the foregoing disclosure, if the arch elements are of equal length, the staggered orientation will define a gap between adjacent arch elements. Such a gap is indicated in FIGS. 5 and 6 as gap 70. If this gap is not covered, soil, water or the like may migrate into the bridge with undesired consequences.

Figure 7:
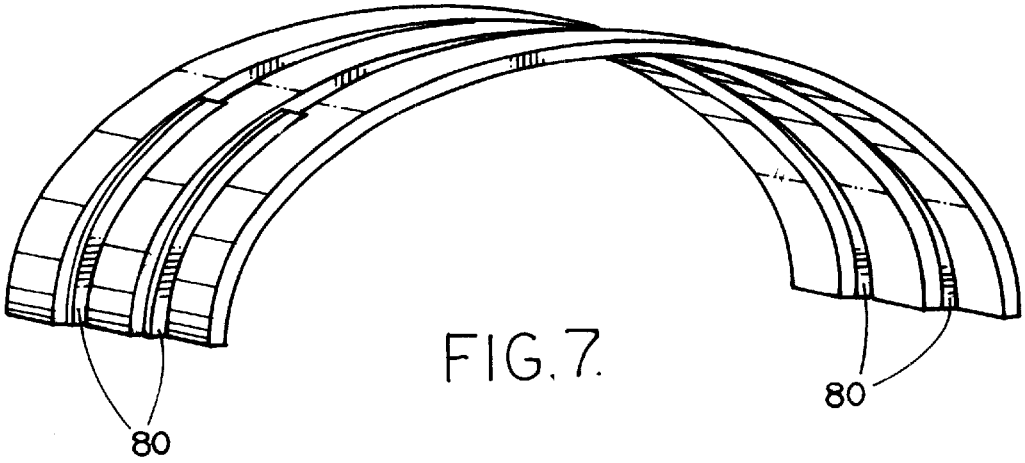
FIG. 7 is a perspective view of a skewed bridge of the present invention with one form of gap closing element.
Figure 8:
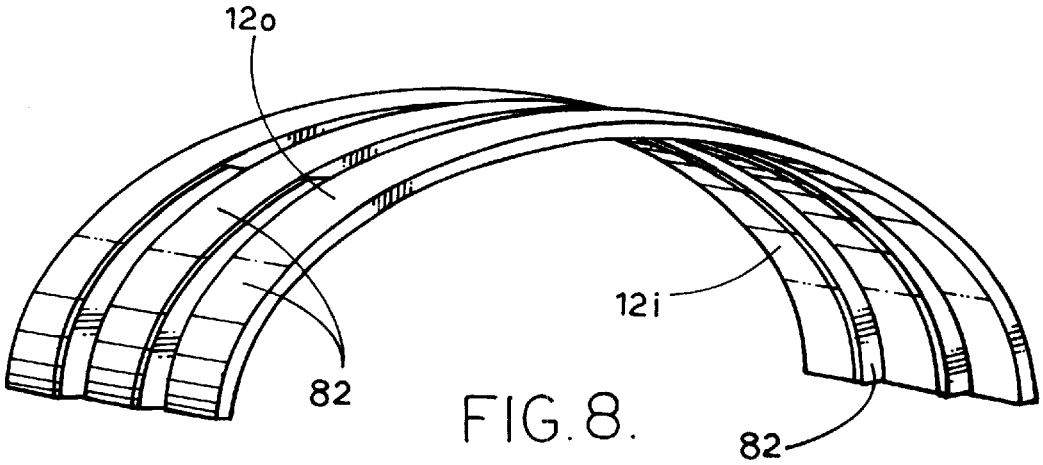
FIG. 8 is a perspective view of a skewed bridge of the present invention with another form of gap closing element.
Figure 9:
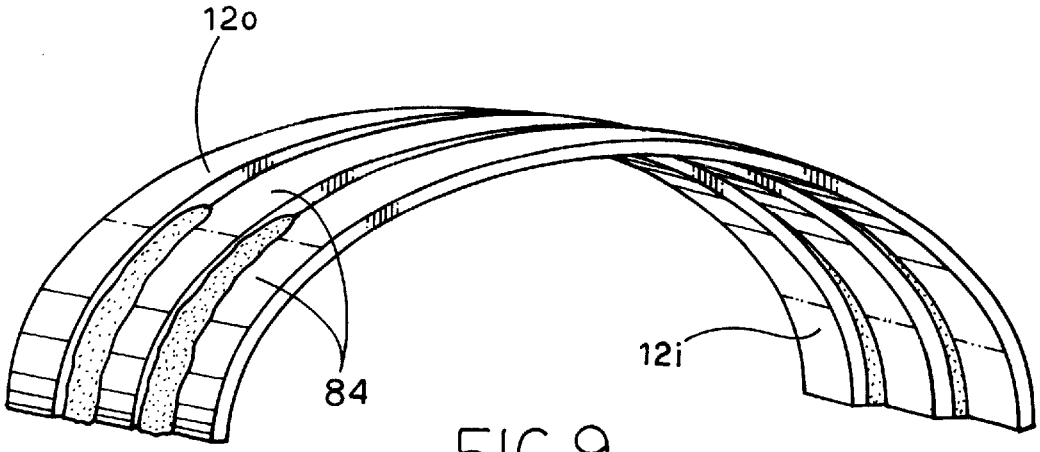
FIG. 9 is a perspective view of a skewed bridge of the present invention with another form of gap closing element.

Accordingly, the bridge embodying the present invention includes a cover element to cover the gap formed between adjacent staggered arch elements. One form of gap cover is shown in FIG. 7 as a pre-cast gap cover element 80, and another form of the gap cover element is shown in FIG. 8 as a steel-fiber concrete gap cover element 82 (however, other materials such as composite or steel can also be used without departing from the scope of this invention). Gap cover element 84 is shown in FIG. 9 and is yet another form of the gap cover element and gap cover elements 84 are formed of steel-fiber reinforced shotcrete which can be applied to the outside surfaces and to the inside surfaces of the arch elements as shown at 12*o* and 12*i* respectively. It is noted that any of the gap cover elements of this disclosure can be used on either or both of the inside or outside surfaces of the arch elements.

Figure 10:
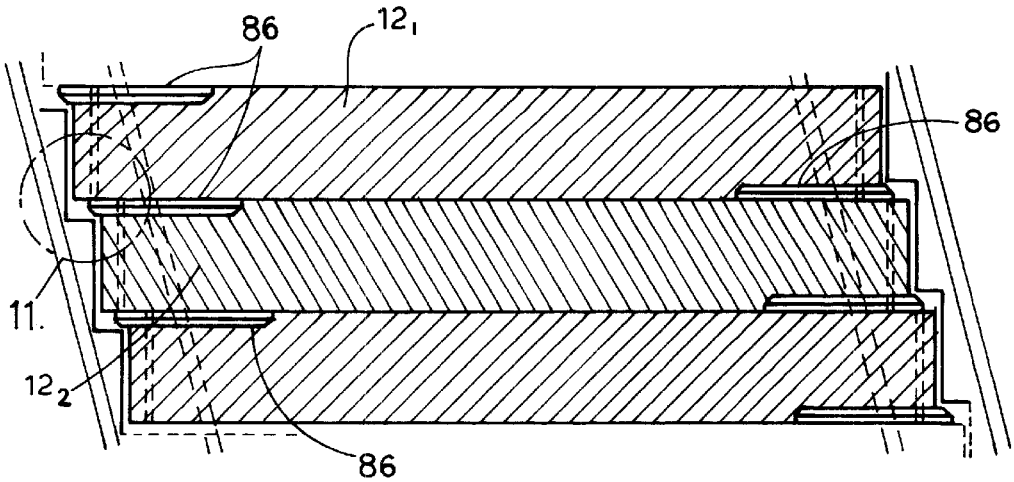
FIG. 10 and 11 show details of yet another form of gap closing element.
Figure 11:
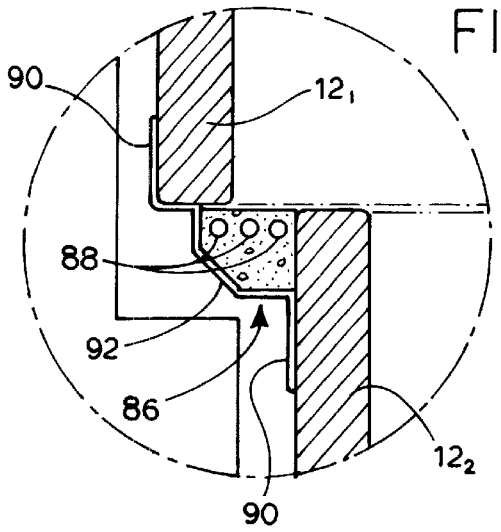

Shown in FIGS. 10 and 11 is a gap cover element 86 which is anchored to the foundation structure of the bridge. Element 86 can be formed of any of the above-mentioned materials, but is preferably precast. As shown in FIG. 11, elements, such as dowels 88 are anchored to the foundation structure and are located within the gap cover element. Water proofing layers 90 are also included to further ensure that moisture or soil do not migrate into the bridge via any gaps formed between adjacent staggered arch elements. As shown, adjacent arch elements 12, and $\mathbf{12}_2$ are free to move with respect to each other. The layers can be flexible so relative movement between the adjacent arch elements will not adversely affect the function of the gap cover element.

Figure 12:
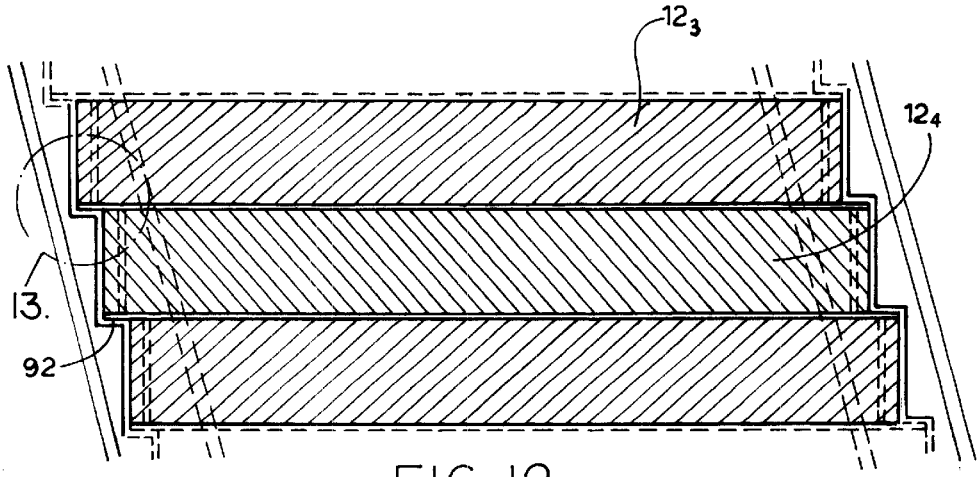
FIGS. 12 and 13 show details of a gap closing element which permits movement of one arch element with respect to an adjacent arch element.
Figure 13:
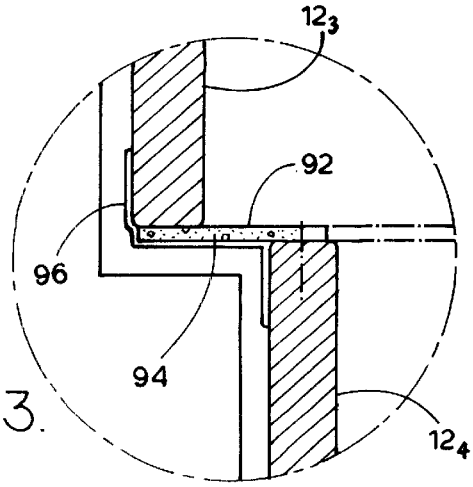

Yet another form of gap cover element is shown in FIGS. 12 and 13 as element 92 that is fixed to one arch element of adjacent arch elements $\mathbf{12}_3$ and $\mathbf{12}_4$ by means such as dowels 94. A waterproof cover 96 is also included. The thickness d of element can be adjusted to account for soil pressure on the bridge. Element 92 is fixed to one arch element to permit relative movement between the adjacent arch elements.

Figure 14:
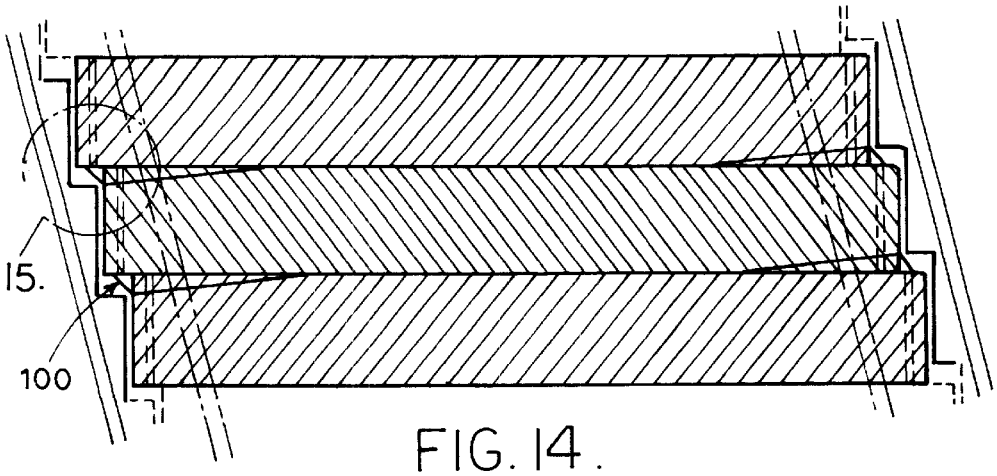
FIGS. 14 and 15 show details of a gap closing element.
Figure 15:
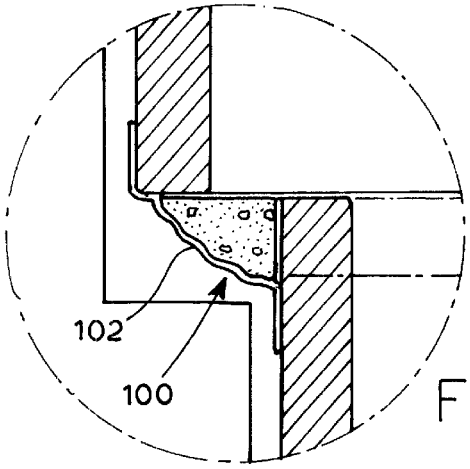

Shown in FIGS. 14 and 15 is another form of the gap cover element indicated as element 100. Element 100 is formed of steel-fiber reinforced shotcrete and includes a waterproof cover 102.

By way of reference various intersection angles are indicated in FIGS. 10, 12 and 14.

Shown in FIG. 16 is a minimum clear area which is spanned by the skewed arch embodying the present invention for a intersection angle of $\alpha$=75°. Due to the skew and the jagged arrangement of the elements, the minimum clear area (perpendicular to the axis of the pathway located beneath the bridge) is somewhat smaller than the clear area associated with bridge P. This factor is accounted for in the design of bridge 10.

Shown in FIG. 17 is a bridge 10' for use with skewed pathways and which includes twin leaf arch elements $\mathbf{12}_5$ and $\mathbf{12}_6$ which include two pre-cast arch elements such as disclosed in U.S. patent application Ser. No. 09/227,826 filed on Jan. 11, 1999 and assigned to BEBO of America and issued on Jun. 12, 2001 as U.S. Pat. No. 6,244,3994, the assignee of the instant invention, the disclosure of the just-mentioned patent application Ser. No. 09/227,826 is incorporated herein by reference. The twin leaf arch elements are staggered with respect to each other in the same manner as discussed above, such as in regard to arch elements 12 shown in FIG. 2. Accordingly, no further discussion will be presented, but the discussion associated with the staggering of adjacent arch elements presented above is incorporated here by reference.

Figure 18:
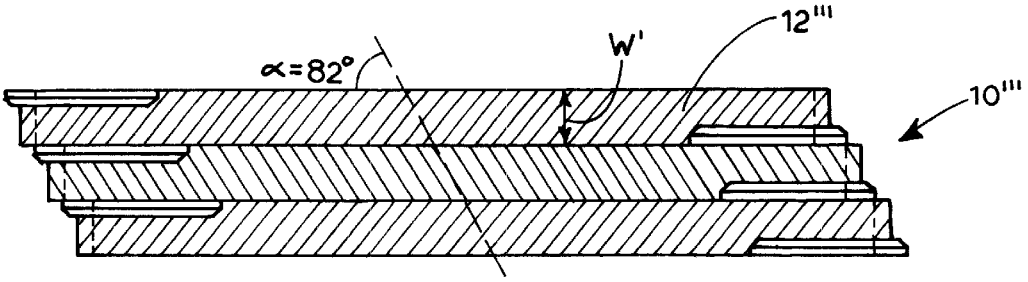
FIG. 18 shows a skewed bridge embodying the present invention in which arch elements are narrower than the arch elements associated with the bridge shown in FIG. 2.
Figure 19:
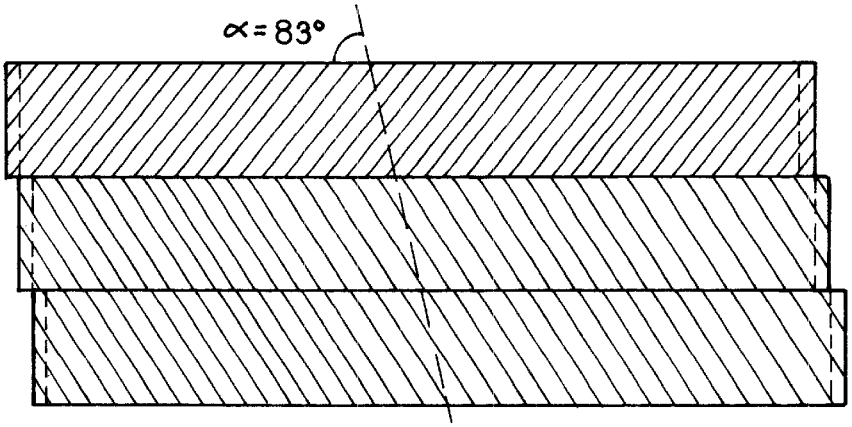
FIG. 19 shows a skewed bridge without gap closing elements.

As discussed above, one of the advantages of the skewed bridge embodying the present invention is that all of the arch elements used in the bridge can be the same shape. This permits a manufacturer to have a multiplicity of arch elements on hand and makes the manufacturing process much easier than if special arch element shapes must be formed. Shown in FIG. 18 is a skewed bridge 10"which includes some arch elements 12"that have a width dimension W" that is less than the width dimension W shown in FIG. 2 for arch elements 12. An example of the width dimensions includes W" for arch elements 12"being one-half of the thickness W for arch elements 12 shown in FIG. 2. Bridge 10"also includes gap cover elements similar to those gap cover elements discussed above in FIGS. 8–15 so these gap cover elements will not be again discussed, but reference is made to the discussion associated with those gap cover elements. It is also noted that the smaller width arch elements can be twin leaf arch elements as well without departing from the scope of the present disclosure. Furthermore, any combination of arch element widths can be used in a single bridge without departing from the scope of this disclosure. For example, some of the arch elements can be arch elements 12 and other arch elements of the same bridge can be arch elements 12". Various combinations of arch elements will occur to those skilled in the art based on the teaching of this disclosure and are intended to be encompassed by this disclosure. It is also noted that the same basic arch element mold can be used for either width arch element. A mold can be divided by appropriate walls to form a plurality of arch elements. Shipping can be effected by tying several arch elements together as well.

As examples of the skewed arch bridge of the present invention, it is noted that intersection angles of $\alpha$=73°, 75° (FIG. 2), 62°, 76°, 83° can be established using various width arch elements and/or combinations of arch elements. The preferred width of the arch elements is either six feet (arch elements 12) or three feet (arch elements 12").

It is understood that while certain forms of the present invention have been illustrated and described herein, it is not to be limited to the specific forms or arrangements of parts described and shown.

What is claimed is:

1. An overfilled, pre-cast, reinforced concrete arch skewed bridge comprising a plurality of non-skewed arch elements which are offset from each other to form a skewed bridge having a longitudinal centerline at an oblique intersection angle with respect to a plane containing one surface of a front or rear surface of one of said arch elements.

2. The bridge defined in claim 1 wherein each arch element is pre-cast reinforced concrete.

3. The bridge defined in claim 1 wherein the plane containing the front surface of each arch element is parallel to the plane containing the rear surface of each arch element.

4. The bridge defined in claim 3 wherein the planes containing the front and rear surfaces of each arch element are parallel with each other and with planes containing the front and rear surfaces of arch elements adjacent thereto whereby all of the planes containing the front and rear surfaces of the arch elements in the skewed bridge are parallel with each other.

5. The bridge defined in claim 2 wherein each arch element includes an inner surface and an outer surface with a portion of the outer surface of one arch element being spaced from a corresponding portion of an adjacent arch element to define a discontinuity between said one arch element and said adjacent arch element.

6. The bridge defined in claim 5 further including a cover element extending over said discontinuity.

7. The bridge defined in claim 6 wherein said cover element is pre-cast.

8. The bridge defined in claim 6 wherein said cover element is formed of steel fiber concrete.

9. The bridge defined in claim 6 wherein said cover element is steel fiber shotcrete.

10. The bridge defined in claim 6 wherein said cover element further includes anchors fixing said cover element to a foundation.

11. The bridge defined in claim 6 wherein said cover element is fixed to one of said arch element and said adjacent arch element.

12. The bridge defined in claim 6 further including formwork adjacent to said cover element.

13. The bridge defined in claim 6 wherein said cover element is reinforced concrete.

14. The bridge defined in claim 6 wherein said cover element is unreinforced concrete.

15. The bridge defined in claim 6 wherein said cover element includes a waterproofing layer.

16. In combination:

A) a first pathway and a second pathway beneath said first pathway, said first and second pathways being oriented at an oblique angle to each other whereby said first and second pathways are skewed with respect to each other; and B) an overfilled, pre-cast, reinforced concrete skewed bridge supporting one pathway of said first and second pathways over the other pathway of said first and second pathways, said skewed bridge comprising a plurality of pre-cast, reinforced concrete arch elements, with each arch element including an arcuate body having a front surface and a rear surface and a widthwise centerline extending from the front surface to the rear surface with planes containing the front and rear surfaces being parallel with each other and oriented at a 90° angle to the widthwise centerline of the arch element corresponding to those front and rear surfaces, each arch element being offset from adjacent arch elements so the widthwise centerlines of adjacent arch elements are non-aligned.

17. The bridge defined in claim 1 wherein at least one arch element of said arch elements is a twin leaf arch element.

18. The bridge defined in claim 1 wherein each arch element of said plurality of arch elements has a front surface and a rear surface and a width dimension which is measured between the front surface and the rear surface and at least one arch element of said plurality of arch elements has a width dimension which is different from the width dimension of the remaining arch elements.

19. The bridge defined in claim 1 further including a unitary foundation on which all arch elements of said plurality of arch elements are supported, said foundation extending adjacent to and along the longitudinal centerline of the bridge.

20. The bridge defined in claim 16 further including a unitary foundation on which all arch elements of said plurality of arch elements are supported, said foundation extending adjacent to and along the other pathway.

21. The bridge defined in claim 1 wherein all of the arch elements are identical to each other.

22. A foundation for an overfilled, pre-cast, reinforced concrete bridge comprising.

A) a foundation footing; and

B) a foundation key which includes a first section having a first width dimension and a second section having a second width dimension, said second width dimension being greater than said first width dimension.

23. The foundation defined in claim 22 wherein said first and second sections intersect each other to form an L-shape.

24. The foundation defined in claim 23 wherein said foundation includes a plurality of first sections and a plurality of second sections which define a zig-zag shaped foundation key.

25. The bridge defined in claim 1 wherein said arch elements are arcuate in peripheral shape.

26. The foundation defined in claim 22 wherein said foundation footing includes side walls and said first and second sections are oriented at an oblique angle to the side walls of said footing.

27. The foundation defined in claim 26 wherein said first sections are oriented at an oblique angle to the side walls of said footing.

28. The foundation defined in claim 26 wherein second sections are oriented at an oblique angle to the side walls of said foundation footing.

29. An overfilled, pre-cast, reinforced concrete bridge which supports a first pathway over a second pathway with the first and second pathways being oriented at an oblique angle with respect to each other, said bridge comprising:

a plurality of arch elements with each arch element having a length dimension extending at an oblique angle with respect to the direction of the second pathway and a width dimension extending at a right angle to said length dimension and along the direction of said first pathway and a widthwise centerline extending in the direction of the width dimension, said arch elements being oriented with respect to each other so that adjacent arch elements have parallel length dimensions and parallel width dimensions and offset width dimensions whereby the widthwise centerline of one arch element is non-aligned with and offset from the widthwise centerline of adjacent arch elements.

30. An overfilled, pre-cast, reinforced concrete arch bridge which supports a first pathway over a second pathway with the first and second pathways being oriented at an oblique angle with respect to each other, said bridge comprising:

a plurality of arch elements with each arch element having a length dimension extending at an oblique angle with respect to the direction of the second pathway and a width dimension extending at a right angle to said length dimension and at an oblique angle to the direction of said first pathway, and a widthwise centerline extending in the direction of the width dimension, said arch elements being oriented with respect to each other so that adjacent arch elements have parallel length dimensions and parallel width dimensions and offset width dimensions whereby the widthwise centerline of one arch element is non-aligned with and offset from the widthwise centerline of adjacent arch elements.

31. The foundation defined in claim 22 wherein said foundation footing extends parallel to one pathway of two pathways which are oriented at an oblique angle with respect to each other.

32. The foundation defined in claim 22 further including two arch sections each having a front surface and a rear surface and a width dimension measured between said front and rear surfaces and wherein the first width dimension of said first section of said foundation key is equal to the width dimension of the arch sections.

33. The bridge defined in claim 1 wherein said offset is in a horizontal plane.

* * * * *